US012624525B2

(12) United States Patent
Yonekura

(10) Patent No.: US 12,624,525 B2
(45) Date of Patent: May 12, 2026

(54) CONSTRUCTION MACHINE

(71) Applicant: Yanmar Holdings Co., Ltd., Osaka (JP)

(72) Inventor: Kiyoshi Yonekura, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 386 days.

(21) Appl. No.: 18/037,052

(22) PCT Filed: Dec. 17, 2021

(86) PCT No.: PCT/JP2021/046841
§ 371 (c)(1),
(2) Date: May 15, 2023

(87) PCT Pub. No.: WO2022/131376
PCT Pub. Date: Jun. 23, 2022

(65) Prior Publication Data

US 2024/0026642 A1 Jan. 25, 2024

(30) Foreign Application Priority Data

Dec. 18, 2020 (JP) ..... 2020-210240

(51) Int. Cl.
*E02F 9/20* (2006.01)
*E02F 3/76* (2006.01)
*E02F 9/22* (2006.01)

(52) U.S. Cl.
CPC ..... *E02F 9/2004* (2013.01); *E02F 3/7613* (2013.01); *E02F 3/7618* (2013.01); *E02F 9/2203* (2013.01); *E02F 9/2285* (2013.01); *E02F 9/2292* (2013.01)

(58) Field of Classification Search
CPC ..... E02F 9/2004; E02F 9/2203; E02F 9/2285; E02F 9/2292; E02F 3/7613; E02F 3/7618
USPC ..... 172/818–828
See application file for complete search history.

(56) References Cited

U.S. PATENT DOCUMENTS 3,517,568 A * 6/1970 Payerle ..... E02F 9/2004 74/471 XY
5,620,053 A * 4/1997 Kamikawa et al. .. E02F 3/7618 172/4
2005/0205272 A1* 9/2005 Suzuki et al. ..... E02F 3/844 172/812
2018/0266083 A1* 9/2018 Narikawa et al. ..... E02F 3/435

FOREIGN PATENT DOCUMENTS

JP 2005207196 A 8/2005
JP 2019167686 A 10/2019

* cited by examiner

*Primary Examiner* — Tara Mayo
(74) *Attorney, Agent, or Firm* — Chris Mizumoto

(57) ABSTRACT

This construction machine includes a blade and a manipulating lever. The blade is provided to a machine body. The blade is configured such that a plurality of operations are possible. The manipulating lever manipulates the blade. The manipulating lever is configured so as to be able to control each of the plurality of operations by a different manipulation. The manipulating lever is preferably configured so as to be able to manipulate each of the plurality of operations in the same direction.

10 Claims, 7 Drawing Sheets

CONSTRUCTION MACHINE

CROSS-REFERENCE

This application is a US National Stage Application under 35 U.S.C. § 371 of International Application No. PCT/JP2021/046841 filed Dec. 17, 2021, which claims foreign priority of JP2020-210240 filed Dec. 18, 2020 and the disclosures of which are hereby incorporated by reference in their entirety.

TECHNICAL FIELD

The present invention relates to a construction machine.

BACKGROUND ART

The working machine of Patent Literature 1 has a blade provided on a lower traveling body thereof so as to be capable of performing an elevating operation, an angular operation, and a tilting operation. In the working machine of Patent Literature 1, a blade lever is tilted in a forward and backward direction to lift the blade. Additionally, the blade lever is tilted in a left and right direction to cause the blade lever to perform the tilting operation and the angular operation. Switching between the tilting operation and the angular operation is performed using a button switch at a distal end of the blade lever.

CITATION LIST

Patent Literature

Patent Literature 1: Japanese Patent Laid-Open Publication No. 2005-207196

DISCLOSURE OF INVENTION

Problems to be Solved by the Invention

However, in the working machine of Patent Literature 1, the tilting operation and the angular operation mean tilting of the blade lever in the left and right direction, and the operations are common. Thus, there is a possibility of causing any malfunction. For example, there is a possibility that the tilting operation is intended to be performed, but the angular operation may be performed by mistake.

The present invention has been made in light of the above-mentioned problem, and the object is to provide a construction machine capable of suppressing occurrences of malfunctions.

Means for Solving the Problems

A construction machine according to the present invention is provided with a blade and a manipulation lever. The blade is provided on a machine body. The blade is configured to be capable of performing a plurality of operations. The manipulation lever manipulates the blade. The manipulation lever is configured to be capable of controlling the plurality of operations by individual different manipulations.

Effect of the Invention

The present invention enables occurrences of malfunctions to be suppressed.

BRIEF DESCRIPTION OF DRAWINGS

FIG. 4(*b*) is a rear diagram of the third manipulation lever.

DESCRIPTION OF EMBODIMENTS

Figure 1:
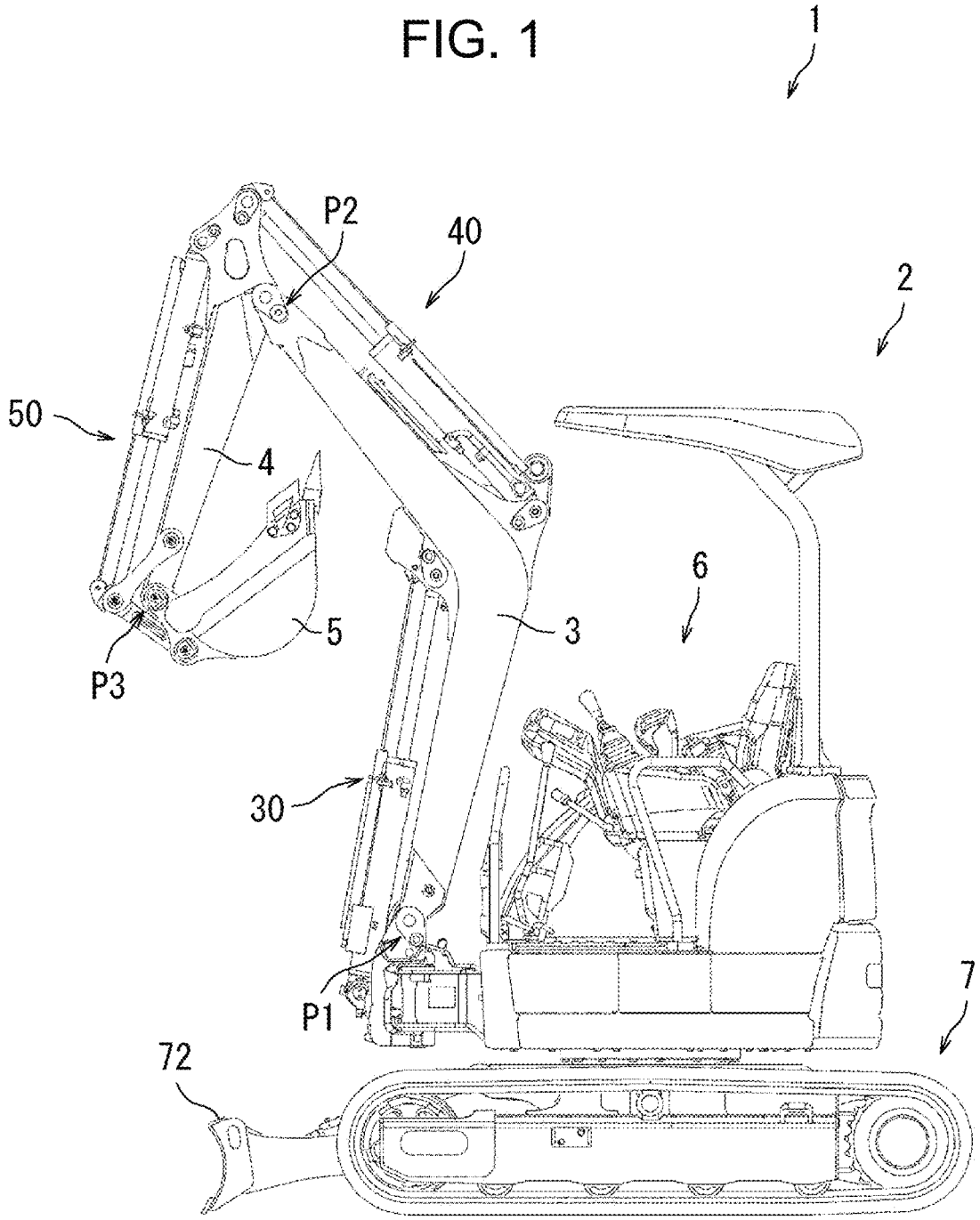
FIG. 1 is a side diagram of a construction machine according to the present embodiment.

Descriptions will hereinafter be made on embodiments according to the present invention with reference to the drawings. It is noted that same or corresponding portions in the drawings are provided with the same reference characters and will not be repeatedly described.

First, a construction machine 1 according to the present embodiment will be described with reference to FIG. 1. FIG. 1 is a side diagram of the construction machine 1 according to the present embodiment. As illustrated in FIG. 1, the construction machine 1 according to the present embodiment is a backhoe. The construction machine 1 according to the present embodiment has a machine body 2, a boom 3, an arm 4, a bucket 5, and a traveling device 7. The construction machine 1 according to the present embodiment is further provided with a boom actuator 30, an arm actuator 40, and an attachment actuator 50.

The machine body 2 has a driving seat 6. An operator sits in the driving seat 6 and operates the construction machine 1. The machine body 2 is supported by the traveling device 7. The machine body 2 may be swivelably supported by the traveling device 7. The machine body 2 is provided with an engine, a fuel tank, a battery, a hydraulic system, and a hydraulic oil tank. In addition, there is provided in the machine body 2 a hood that houses the engine, the fuel tank, the battery, the hydraulic system, and the hydraulic oil tank, and the driving seat 6 is arranged on the hood.

The boom 3 is supported on the machine body 2 so as to freely oscillate around a first rotation fulcrum P1. Specifically, a base end part of the boom 3 is pivotally supported on by the machine body 2. The first rotation fulcrum P1 is a rotary axis that extends along a left and right direction in viewing the driving seat 6 from the front. Hereinafter, the left and right direction in viewing the driving seat 6 from the front may be described as "the left and right direction".

The boom actuator 30 operates the boom 3. Specifically, as a result of the expansion and contraction of the boom actuator 30, the boom 3 oscillates around the first rotation fulcrum P1. In detail, the supply of hydraulic oil to the boom actuator 30 and the discharge of hydraulic oil from the boom actuator 30 are controlled to expand and contract the boom actuator 30. Thus, the boom actuator 30 is expanded and contracted by hydraulic oil.

The arm 4 is supported on the boom 3 so as to freely oscillate around a second rotation fulcrum P2. Specifically, a base end part of the arm 4 is pivotally supported at a distal end part of the boom 3. The second rotation fulcrum P2 is a rotary axis that extends along the left and right direction.

The arm actuator 40 operates the arm 4. Specifically, as a result of the expansion and contraction of the arm actuator 40, the arm 4 oscillates around the second rotation fulcrum P2. In detail, the supply of hydraulic oil to the arm actuator 40 and the discharge of hydraulic oil from the arm actuator 40 are controlled to expand and contract the arm actuator 40. Thus, the arm actuator 40 is expanded and contracted by hydraulic oil.

The bucket 5 is a type of an attachment. The bucket 5 is supported on the arm 4 so as to freely oscillate around a third rotation fulcrum P3. Specifically, the bucket 5 is pivotally supported at a distal end part of the arm 4. The third rotation fulcrum P3 is a rotary axis that extends along the left and right direction.

The attachment actuator 50 operates the bucket 5. Specifically, as a result of the expansion and contraction of the attachment actuator 50, the bucket 5 oscillates around the third rotation fulcrum P3 In detail, the supply of hydraulic oil to the attachment actuator 50 and the discharge of hydraulic oil from the attachment actuator 50 are controlled to expand and contract the attachment actuator 50. Thus, the attachment actuator 50 is expanded and contracted by hydraulic oil.

The traveling device 7 causes the construction machine 1 to travel. In the present embodiment, the traveling device 7 is a crawler type traveling device. The traveling device 7 has a blade 72. The blade 72 is provided on the machine body 2. The blade 72 is provided so as to extend in a body width direction (left and right-direction). The blade 72 is disposed in front of the traveling device 7.

Figure 2:
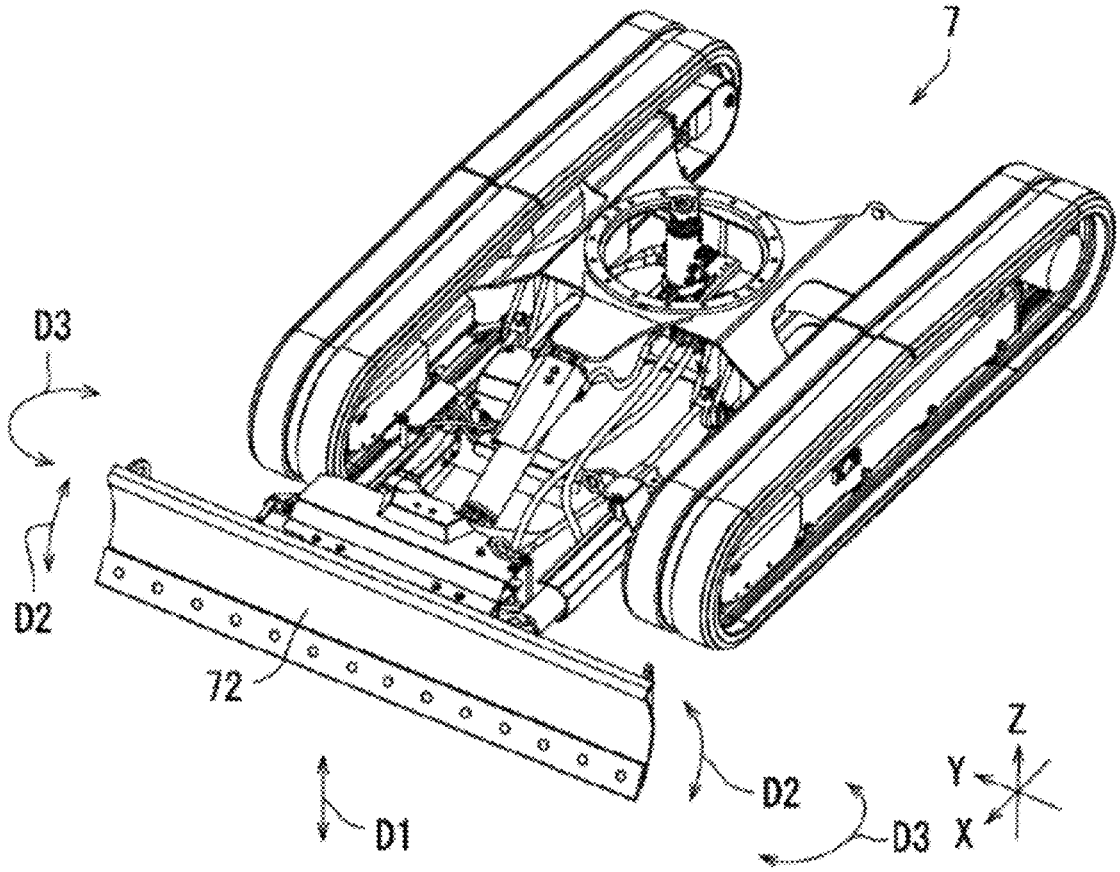
FIG. 2 is schematic perspective diagram of a traveling device in the construction machine.

Operations of the blade 72 will be described with reference to FIG. 2. FIG. 2 is a schematic perspective diagram of the traveling device 7 in the construction machine 1.

The blade 72 is configured so as to be capable of performing a plurality of operations, that is to say, a lifting operation, a tilting operation, and an angular operation.

The lifting operation indicates that the entire blade 72 moves along a direction D1 in a vertical direction. The tilting operation indicates that each of a left end and a right end of the blade 72 moves along a direction D2 in a vertical direction. The angular operation indicates that each of the left end and the right end of the blade 72 moves along a direction D3 in a forward and backward direction.

Figure 3:
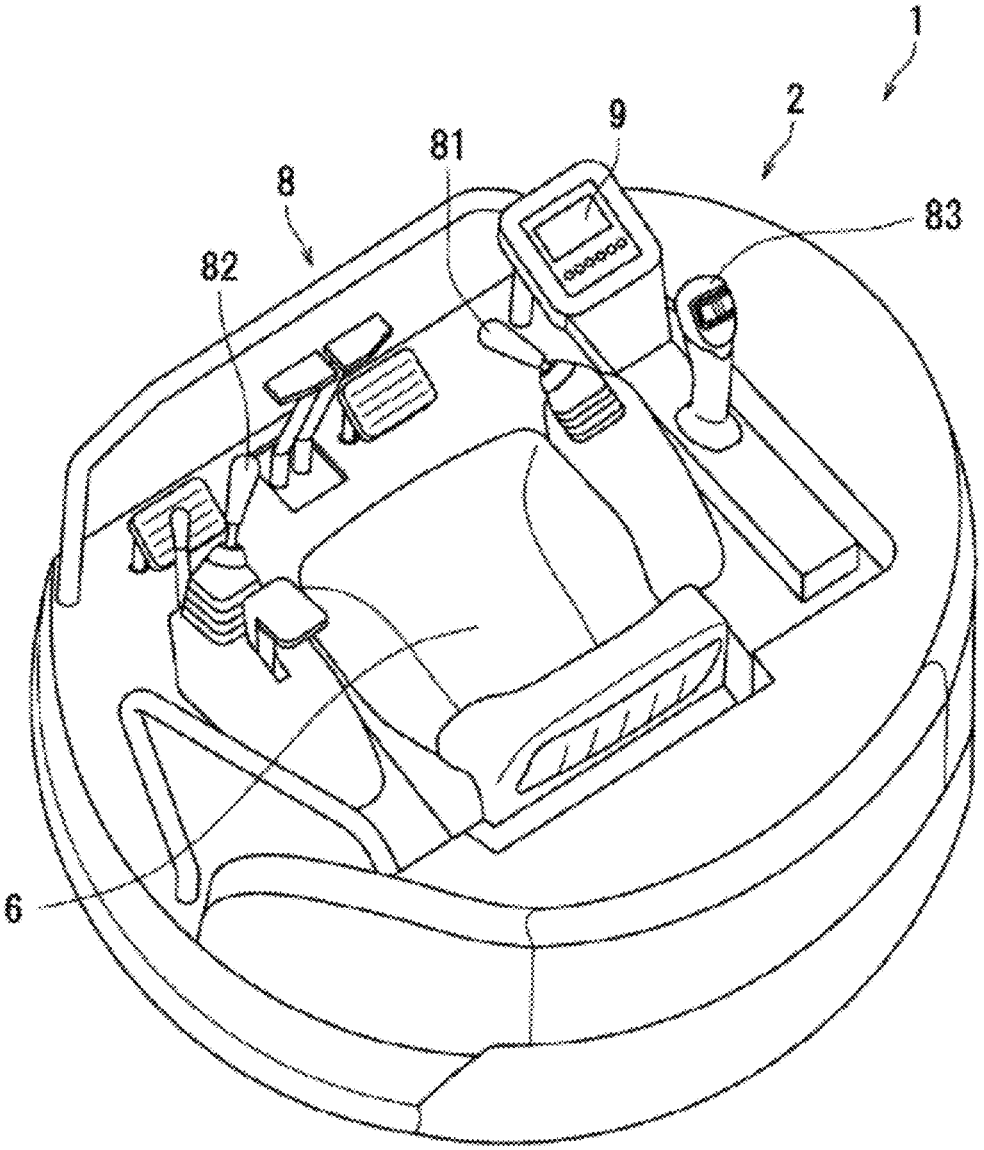
FIG. 3 is a perspective diagram of a machine body of the construction machine.

Subsequently, a configuration of the construction machine 1 will be further described with reference to FIG. 1 to FIG. 3. Specifically, a configuration around the driving seat 6 will be described. FIG. 3 is a perspective diagram of the machine body 2 in the construction machine 1.

As illustrated in FIG. 3, the construction machine 1 is further provided with a steering unit 8 and a display device 9. The steering unit 8 and the display device 9 are provided on the machine body 2. Specifically, the steering unit 8 and the display device 9 are arranged in front of the driving seat 6.

The steering unit 8 includes various kinds of manipulation members for an operator to steer the construction machine 1. The various kinds of manipulation members include a first manipulation lever 81, a second manipulation lever 82, and a third manipulation lever 83. In detail, the operator manipulates the first manipulation lever 81, the second manipulation lever 82, and the third manipulation lever 83 by hand. The operator can the boom 3 and the bucket 5 to operate by manipulating the first manipulation lever 81. Also, the operator can cause the arm 4 to operate and cause the machine body 2 to swivel by manipulating the second manipulation lever 82. In addition, the operator can cause the blade 72 to operate by manipulating the third manipulation lever 83. It is noted that the third manipulation lever 83 is one example of the "manipulation lever" according to the present invention.

The display device 9 displays various kinds of screens.

Figure 4:
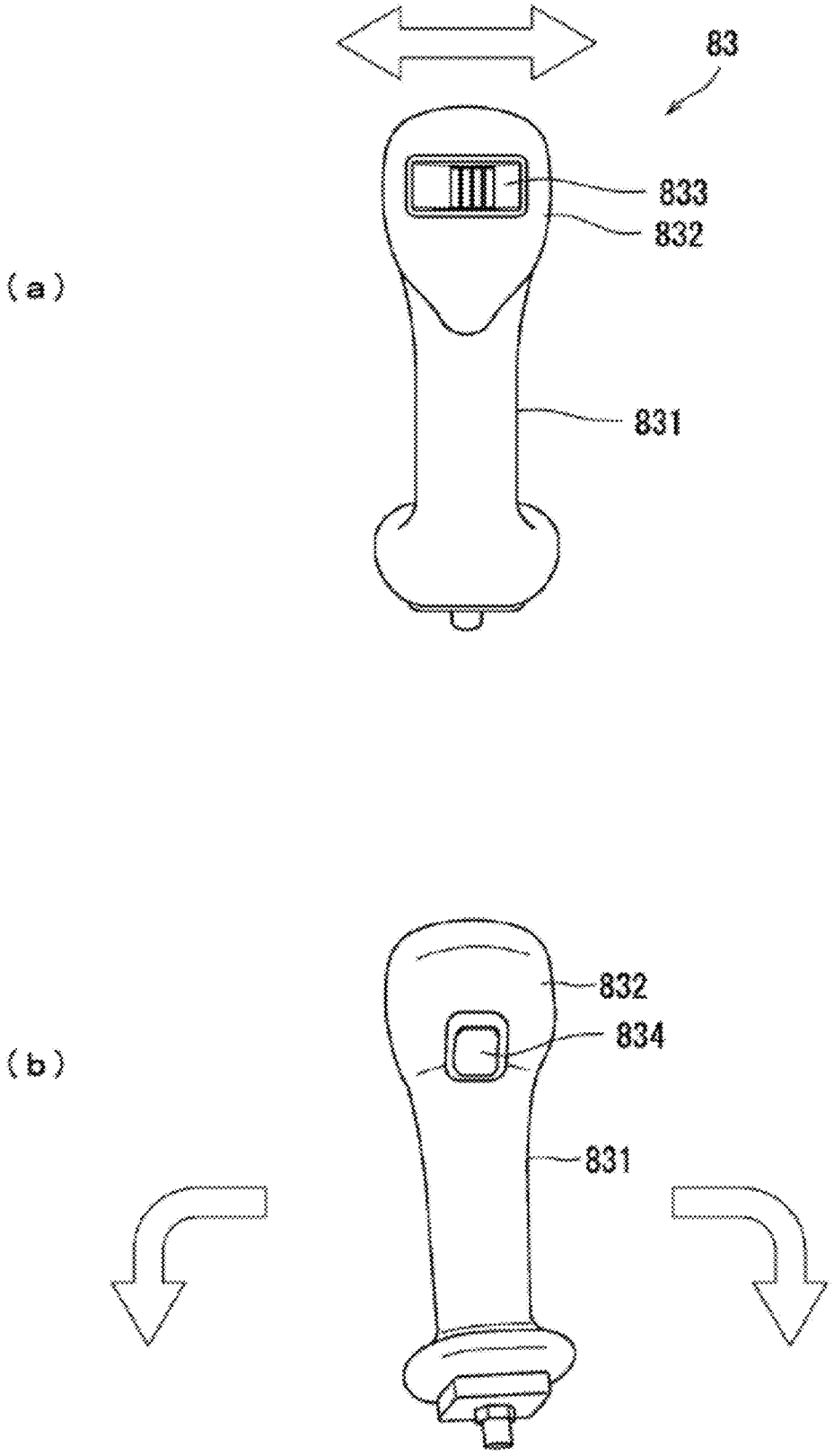
FIG. 4(*a*) is a front diagram of a third manipulation lever.
Figure 5:
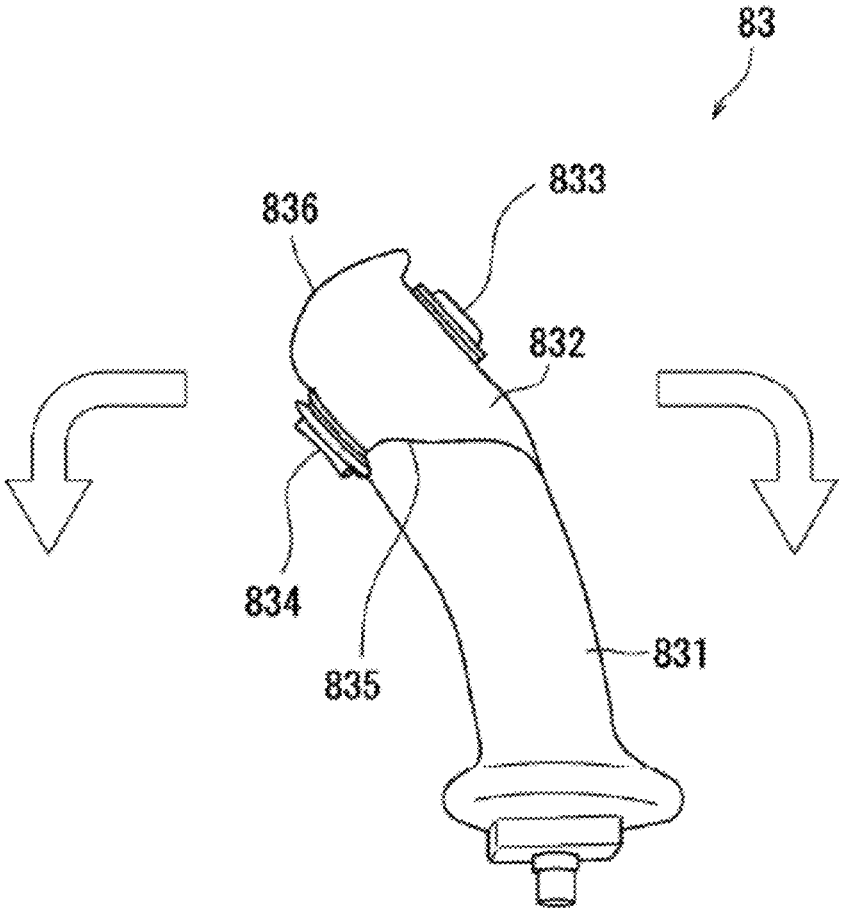
FIG. 5 is a side diagram of the third manipulation lever.

The third manipulation lever 83 will be further described with reference to FIG. 4 and FIG. 5. FIG. 4(*a*) is a front diagram of the third manipulation lever 83. FIG. 4(*b*) is a rear diagram of the third manipulation lever 83. FIG. 5 is a side diagram of the third manipulation lever 83.

As illustrated in FIG. 4(*a*), the third manipulation lever 83 has a lever body 831, a grip section 832, and a manipulation switch 833. The third manipulation lever 83 manipulates the blade 72. The third manipulation lever 83 is configured to be capable of controlling by individual different manipulations a plurality of operations of the blade 72, for example, an angular operation and a tilting operation. The third manipulation lever 83 is configured so as to be capable of manipulating each of the angular operation (one of the plurality of operations) and the tilting operation (another operation) in a same direction. The different manipulations refer, for example, to a manipulation of a different portion in the third manipulation lever 83, one of which is a manipulation of the lever body 831 and another one of which is a manipulation of the manipulation switch 833. Alternatively, in a case where manipulations of the same portion (for example, lever body 831) in the third manipulation lever 83 are performed, however, in individual different directions, the manipulations are individually different.

The lever body 831 can be manipulated in at least one direction (for example, forward, backward, left, and right). The manipulations of the lever body 831 includes, for example, a manipulation for tilting the lever body 831 and a manipulation for turning the lever body 831 in a predetermined direction. In the manipulation for turning, it is defined that a direction in which a rear face of the lever body 831 turns to the right side is as a right turning direction and that a direction in which it turns to the left side is as a left turning direction.

In the present embodiment, the manipulation for tilting the lever body 831 is hereinafter described as the manipulation of the lever body 831.

The grip section 832 is disposed at a distal end part of the lever body 831.

The manipulation switch 833 is disposed at the grip section 832. Specifically, the manipulation switch 833 is disposed at a front side of the grip section 832. For example, the front side is a side where the driving seat 6 is located. The manipulation switch 833 is formed to be operable in a predetermined direction (for example, left and right, up and down) with respect to the grip section 832. The manipulation switch 833 is a roller switch or a slide switch. In the present embodiment, a tilting operation is carried out when the manipulation switch 833 is manipulated to the left or right (an arrow direction illustrated in the drawing). In detail, the tilting operation is carried out through slide-manipulation of the manipulation switch 833 to the left or right by operator's fingertip.

As illustrated in FIG. 4(*b*), the third manipulation lever 83 further has a changeover switch 834.

The changeover switch 834 is disposed at a rear side of the grip section 832. For example, the rear side is a side far from the driving seat 6. The changeover switch 834 is configured so as to be capable of being pushed down. The changeover switch 834 is disposed at the rear side of the grip section 832, so that the changeover switch 834 can be located in a position that the operator's index finger touches when the operator holds the grip section 832. Therefore, it is easier to push down the changeover switch 834. The changeover switch 834 enables either one of one operation (angular operation) and another operation (tilting operation) among a plurality of operations. According to the present embodiment, it is configured that the tilting operation is disabled as well as the angular operation is enabled through manipulation of the changeover switch 834. Specifically, in a state where the changeover switch 834 is pushed down, the tilting manipulation is disabled as well as the angle manipulation is enabled. The angular operation is performed by tilting the grip section 832 of the third manipulation lever 83 simultaneously with the manipulation of the changeover switch 834. That is to say, an operator tilts the grip section 832 of the third manipulation lever 83 while pressing down the changeover switch 834, so that the angular operation is performed As illustrated in FIG. 5, a lifting operation is carried out by tilting the grip section 832 of the third manipulation lever 83 to back and forth. The grip section 832 is formed to incline downward from a base end part 835 thereof toward a distal end part 836 thereof. Thus, an operator can easily tilt the third manipulation lever 83 to back and forth.

Either one of a tilting operation and an angular operation is performed by tilting the grip section 832 in a predetermined direction. The other one of the tilting operation and the angular operation is performed through manipulation of the manipulation switch 833. According to the present embodiment, one is an angular operation. The angling operation is performed by tilting the grip section 832 in a predetermined direction. The other one is a tilting operation. In other words, the tilting operation is performed through manipulation of the manipulation switch 833.

As described above with reference to FIG. 1 to FIG. 5, the third manipulation lever 83 (manipulation lever) is configured to be capable of controlling the tilting operation and the angular operation by different manipulations. For example, the tilting operation is performed by finger's manipulation and the angular operation is performed by arm's manipulation. Thus, the possibility of malfunction can be suppressed.

Figure 6:
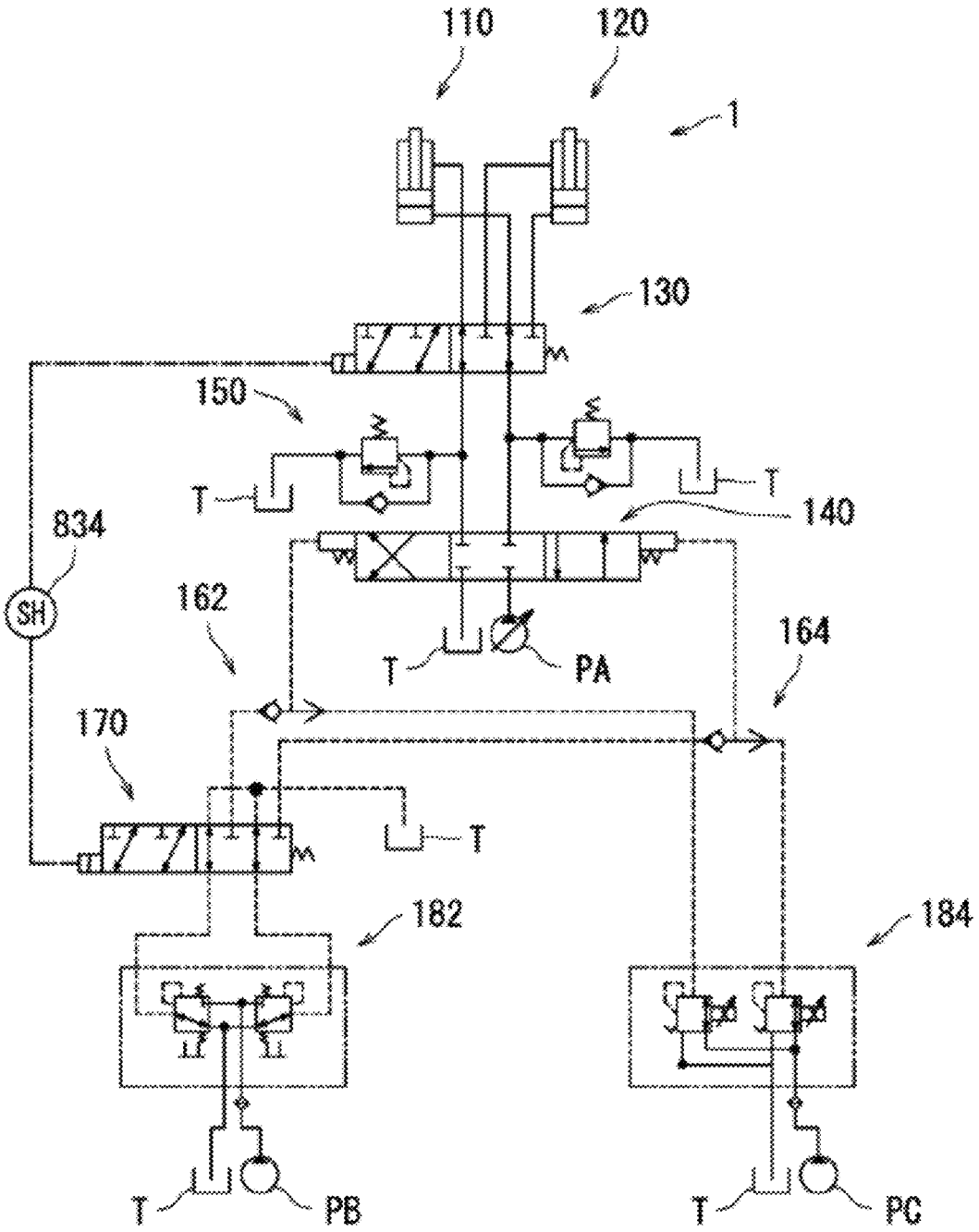
FIG. 6 is a circuit diagram illustrating a configuration of a hydraulic circuit for an angular operation and a tilting operation of a blade.
Figure 7:
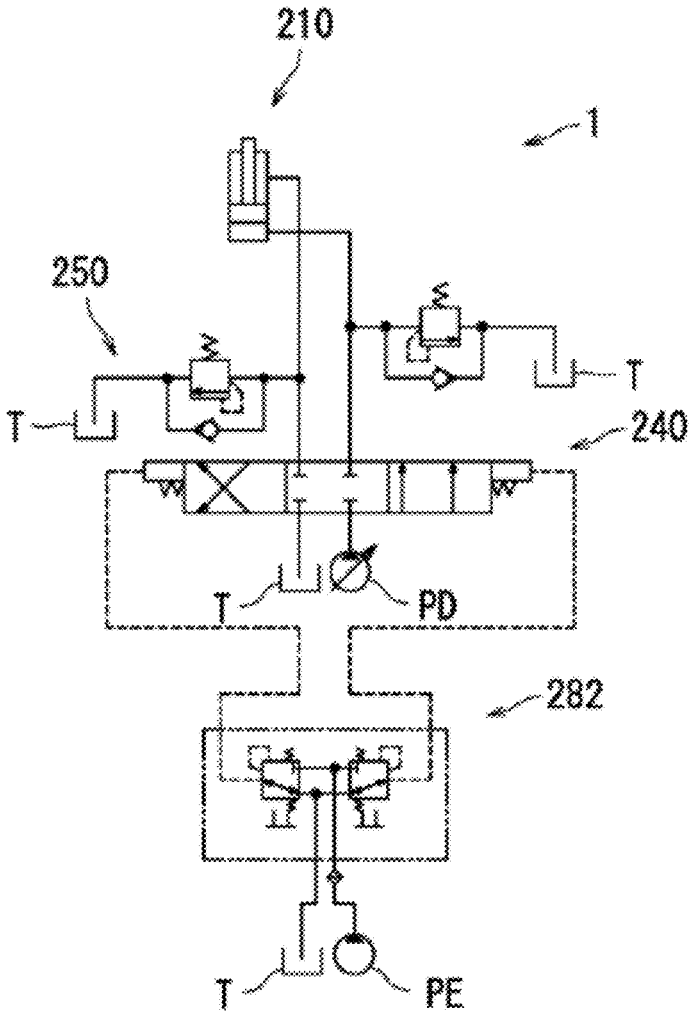
FIG. 7 is a circuit diagram illustrating a configuration of a hydraulic circuit for a lifting operation of the blade.

Descriptions will be made on a configuration of a hydraulic circuit 72 for an operation of the blade 72 of the construction machine 1 with reference to FIG. 6 and FIG. 7. FIG. 6 is a circuit diagram illustrating a configuration of a hydraulic circuit for an angular operation and a tilting operation of the blade 72, and FIG. 7 is a circuit diagram illustrating a configuration of a hydraulic circuit for a lifting operation of the blade 72. It is noted that the circuit for the lifting operation and the circuit for the angular operation and the tilting operation may be configured as a single unit although both circuits are provided as separate units for convenience of description in the present embodiment.

As illustrated in FIG. 6, the hydraulic circuit for the angular operation and the tilting operation includes, from an upstream side of the circuit, an angle pilot valve 182 and a tilt pilot valve 184, a tilt angle control valve 140, a first switching valve 130, a tilt cylinder 110, and an angle cylinder 120.

The angle pilot valve 182 regulates an inflow of pilot oil for an angular operation to the tilt angle control valve 140. In detail, hydraulic oil (pilot oil) can be sent to the tilt angle control valve 140 at a pressure (pilot pressure) corresponding to a manipulation amount determined by the grip section 832 in the third manipulation lever 83. In other words, the angle pilot valve 182 is configured so as to be able of establishing communication on the basis of manipulation signals from the third manipulation lever 83. In detail, the angle pilot valve 182 establishes communication when the third manipulation lever 83 is tilted in a left or right direction. As a result, pilot oil discharged by a pilot pump PB is output at the angle pilot valve 182 in a direction and at a flow rate corresponding to the manipulation amount determined by the third manipulation lever 83.

The tilt pilot valve 184 regulates an inflow of pilot oil for a tilting operation to the tilt angle control valve 140. In detail, hydraulic oil (pilot oil) can be sent to the tilt angle control valve 140 at a pressure (pilot pressure) corresponding to a manipulation amount determined by the manipulation switch 833 on the third manipulation lever 83. In other words, the tilt pilot valve 184 is configured so as to establish communication on the basis of manipulation signals from the manipulation switch 833. In detail, the tilt pilot valve 184 establishes communication when the manipulation switch 833 is manipulated in a left or right direction. As a result, pilot oil discharged by the pilot pump PC is output at the tilt pilot valve 184 in a direction and at a flow rate corresponding to the manipulation amount determined by the manipulation switch 833.

Shuttle valves 162 and 164 are respectively located between the angle pilot valve 182 and the tilt angle control valve 140, and between the tilt pilot valve 184 and the tilt angle control valve 140. The shuttle valves 162 and 164 selectively connect either pilot oil for a tilting operation or pilot oil for an angular operation to the tilt angle control valve 140. It is noted that as described below, the pilot oil for an angular operation is not supplied to the shuttle valve 162 when the changeover switch 834 is not pressed down, and therefore, the pilot oil for a tilting operation is preferentially supplied to the tilt angle control valve 140. On the other hand, when the changeover switch 834 is pressed down, the pilot oil for an angular operation is preferentially supplied to the tilt angle control valve 140.

A second switching valve 170 is disposed between the tilt angle control valve 140 and the angle pilot valve 182. The second switching valve 170 regulates communication between oil paths on the basis of switching signals from the changeover switch 834. In detail, when the changeover switch 834 is pressed down, the pilot oil for an angular operation output from the angle pilot valve 182 is supplied to the shuttle valve 162. On the other hand, when the changeover switch 834 is not pressed down, the pilot oil for an angular operation output from the angle pilot valve 182 is discharged to a tank T.

The tilt angle control valve 140 controls the supply and discharge of hydraulic oil to either one of the tilt cylinder 110 or the angle cylinder 120, and controls an expanding and contracting operation of either one of the tilt cylinder 110 or the angle cylinder 120. In detail, hydraulic oil discharged by a main pump PA is supplied to the tilt cylinder 110 or the angle cylinder 120 in a direction and at a flow rate corresponding to a tilt pilot signal (pilot oil) or an angle pilot signal (pilot oil).

The first switching valve 130 selects either one of the tilt cylinder 110 or the angle cylinder 120 and connects it to the tilt angle control valve 140. In detail, the first switching valve 130 selects either one of the tilt cylinder 110 or the angle cylinder 120 and connects the selected one to the tilt angle control valve 140, depending on whether the changeover switch 834 is pressed down. According to the present embodiment, in a case where the changeover switch 834 is not pressed down, the first switching valve 130 connects the tilt cylinder 110 to the tilt angle control valve 140. On the other hand, in a case where the changeover switch 834 is pressed down, the first switching valve 130 connects the angle cylinder 120 to the tilt angle control valve 140.

The tilt cylinder 110 performs an expanding and contracting operation to cause the blade 72 to perform a tilting operation. The angle cylinder 120 performs an expanding and contracting operation to cause the blade 72 to perform an angular operation.

In addition, the hydraulic circuit for the angular operation and tilting operation of the blade 72 has a relief valve 150 disposed therein between the first switching valve 130 and the tilt angle control valve 140. The relief valve 150 prevents an excessive discharge pressure of a bottom chamber or a rod chamber of the tilt cylinder 110 or of a bottom chamber or a rod chamber of the angle cylinder 120 from being caused. For example, in a case where the tilt cylinder 110 or the angle cylinder 120 is pulled or pushed due to receiving an excessive impact caused by collision of the blade 72 with an obstacle, the relief valve 150 can release an internal pressure in the circuit by allowing oil to flow to the tank T.

As described above with reference to FIG. 6, the first switching valve 130 and the second switching valve 170 can be switched on the basis of switching signals from the changeover switch 834, thereby preventing malfunctions of the tilting operation and the angular operation.

Descriptions will be made on a configuration of a hydraulic circuit for a lifting operation of the blade 72 with reference to FIG. 7. As illustrated in FIG. 7, the hydraulic circuit for a lifting operation includes, from an upstream side of the circuit, a lift pilot valve 282, a lift control valve 240, and a lift cylinder 210.

The lift pilot valve 282 regulates an inflow of pilot oil for a lifting operation to the lift control valve 240. In detail, the hydraulic oil (pilot oil) can be sent to the lift control valve 240 at a pressure (pilot pressure) corresponding to a manipulation amount determined by the grip section 832 in the third manipulation lever 83. In other words, the lift pilot valve 282 is configured so as to establish communication on the basis of manipulation signals from the third manipulation lever 83. In detail, the lift pilot valve 282 is communicated when the third manipulation lever 83 is tilted in a forward and backward direction. As a result, pilot oil that has been discharged by the pilot pump PE is output at the lift pilot valve 282 in a direction and at a flow rate corresponding to the manipulation amount determined by the third manipulation lever 83.

The lift control valve 240 controls an expanding and contracting operation of the lift cylinder 210. In detail, the hydraulic oil discharged by a main pump PD is supplied to the lift cylinder 210 in a direction and at a flow rate corresponding to a lift pilot signal (pilot oil).

The lift cylinder 210 performs an expanding and contracting operation to cause the blade 72 to perform a lifting operation.

In addition, the hydraulic circuit for the lifting operation of the blade 72 has a relief valve 250 disposed therein between the lift cylinder 210 and the lift control valve 240. The relief valve 250 prevents an excessive discharge pressure of a bottom chamber or a rod chamber of the lift cylinder 210 from being caused.

The embodiments according to the present invention have been described hereinabove with reference to the drawings (FIG. 1 to FIG. 7). However, the present invention is not limited to the embodiments described above, and can be performed in various kinds of modes within the scope not departing from the gist thereof. The drawings schematically illustrate elements as a main subject in order to facilitate understanding, and a thickness, a length, and a number of each element illustrated in the drawings may differ from actual ones thereof for the sake of preparation of the drawings. Furthermore, materials, shapes, and dimensions in each element according to the above-mentioned embodiments, which are merely examples, are not intended as specific limitations, and can be variously altered within a scope not substantially departing from effects of the present invention.

DESCRIPTION OF REFERENCE NUMERALS

1 construction machine
2 machine body
72 blade
83 third manipulation lever (manipulation lever)
831 lever body
832 grip section
833 manipulation switch
834 changeover switch
835 base end part
836 distal end part

The invention claimed is:

1. A construction machine comprising:
a blade that is provided on a machine body thereof and is configured to be capable of performing a plurality of operations; and
a manipulation lever that manipulates the blade, wherein the manipulation lever comprises:
a lever body that can be manipulated in at least one direction,
a grip section that is disposed at a distal end part of the lever body, wherein a first operation of the plurality of operations is performed by manipulating the grip section in a predetermined direction, and
a manipulation switch disposed at the grip section and capable of being operated to the left or right with respect to the grip section, wherein a second operation of the plurality of operations is performed by manipulating the manipulation switch;
wherein the manipulation lever is configured to be capable of controlling the plurality of operations by individual different manipulations.

2. The construction machine according to claim 1, wherein
the manipulation lever is configured to be capable of manipulating each of the plurality of operations in a same direction.

3. The construction machine according to claim 1, wherein
the first operation is an angular operation, and the second operation is a tilting operation.

4. The construction machine according to claim 1, wherein the manipulation switch is disposed at a front side of the grip section.

5. The construction machine according to claim 1, wherein the manipulation lever further has a changeover switch for enabling any one of the plurality of operations.

6. The construction machine according to claim 5, wherein manipulation of the changeover switch enables the first operation as well as disables the second operation.

7. The construction machine according to claim 5, wherein the first operation is performed when the grip section is manipulated simultaneously with the manipulation of the changeover switch.

8. The construction machine according to claim 5, wherein the changeover switch is configured to be able to be pushed down.

9. The construction machine according to claim 5, wherein the changeover switch is disposed at a back side of the grip section.

10. The construction machine according to claim 1, wherein the grip section is formed to incline downward from a base end part thereof toward a distal end part thereof.

* * * * *